United States Patent [19]

Yagishita

[11] Patent Number: 4,861,385

[45] Date of Patent: Aug. 29, 1989

[54] ARTICLE WASHING METHOD

[76] Inventor: Aisaburo Yagishita, 5-2, Shinpocho 4 chome, Chikusa-ku, Nagoya-shi, Aichi 464, Japan

[21] Appl. No.: 125,542

[22] Filed: Nov. 25, 1987

Related U.S. Application Data

[63] Continuation of Ser. No. 914,862, Oct. 2, 1986, abandoned.

[51] Int. Cl.[4] ..... B08B 3/02

[52] U.S. Cl. ..... 134/10; 134/25.1; 134/25.2; 134/26; 134/32

[58] Field of Search ..... 134/25.1, 25.4, 10, 134/101, 100, 103, 111, 26, 115 R, 147, 148, 32, 151, 154, 166 R, 170, 186, 187, 188, 200; 422/28, 292, 307, 7

[56] References Cited

U.S. PATENT DOCUMENTS

| | | | |
|---|---|---|---|
| 3,643,791 | 2/1972 | Sadwith | 134/25.4 |
| 4,233,083 | 11/1980 | Roberts | 134/25.4 |
| 4,561,114 | 12/1985 | Marais | 134/25.2 |
| 4,589,926 | 5/1986 | Holmstrand | 134/25.4 |
| 4,617,065 | 10/1986 | Sundheimer | 134/25.4 |

*Primary Examiner*—Asok Pal

*Attorney, Agent, or Firm*—Lowe, Price, LeBlanc, Becker & Shur

[57] ABSTRACT

An article washing method includes the steps of bringing an article into a washing chamber; spraying a first washing liquid fed from a washing liquid tank to the article; separating off an initial most contaminated portion of the washing liquid used; repeating the spray with use of a cleaner washing liquid fed from a second washing liquid tank if required; moving the article after treatment by the spray to a third washing liquid tank to immerse the article in clean washing liquid; and sequentially supplying a part of the clean washing liquid from the latter stage to the washing liquid tank in an earlier stage so as to compensate for a decrease corresponding to the amount of the contaminated washing liquid discharged. The present invention makes it possible to reduce generation of waste liquid to a minimum and provides an improved washing effect by allowing the setting of optimum operational conditions.

13 Claims, 1 Drawing Sheet

ARTICLE WASHING METHOD

This application is a continuation of application Ser. No. 914,862, filed Oct. 2, 1986, now abandoned.

BACKGROUND OF THE INVENTION

The present invention relates to a method of washing an article with a high efficiency by using a single kind of washing liquid.

In manufacturing and processing articles, a washing treatment is often carried out as an intermediate treatment or a post-treatment as well as a pretreatment of materials. For instance, the washing treatment is carried out in the case of removal of chips or cutting oil after cutting of the article, a pretreatment such as degreasing in plating or a post-treatment such as removal of electroplating liquid, and a pretreatment in coating. When the number of articles to be treated is increased, a continuous conveyor system is employed. In this case, the articles are sequentially brought into a tank where a washing liquid is stored, and are passed through the washing liquid. Then, the articles are taken out from the tank, and are fed into another tank. Alternately, the articles are conveyed into a tunnel where injection nozzles for spraying a washing liquid are arranged, the articles being taken out from the tunnel after being spray-cleaned.

However, in this continuous treatment system, while the washing operation is highly efficient, a large amount of washing liquid is required and this causes some economical disadvantages. For example, treatment of waste cleaning fluid to meet pollution control requirements tends to be expensive. Additionally, in the conventional conveyor system, even if the number of articles to be treated varies from time to time, the amount of the washing liquid to be used cannot be so varied.

FIG. 2 shows a flow diagram of a multi-stage article washing process in the prior art. An article 1 is conveyed from the left-hand side, and is immersed in a washing liquid in a washing tank B-1 for 1–3 min., for example. Then, the article 1 is taken out from the tank B-1, and is similarly immersed in a washing liquid in a subsequent washing tank B-2. Then, the article 1 is conveyed to a subsequent washing tank B-3. Such a multi-stage washing system usually includes about three washing tanks. Fresh washing liquid usually is supplied first to the tank B-3 of the final stage, and is sequentially fed to the tanks of the former stages by suitable means such as a communication pipe or an overflow pipe. Finally, the washing liquid used is discharged from the tank B-1 of the initial stage. Thus, the article to be washed is moved relative to the washing liquid in a counter current manner. Accordingly, although the washing effect is improved, the amount of the washing liquid cannot be decreased even when the number of articles to be washed is small, and the washing liquid discharged out of the system often is not very dirty.

In the case where parts of a device surface-treated with chemicals are to be washed by water, a large amount of washing water is used. When the waste water must then be treated by an anti-pollution process, the costs for construction and operation of such treatment equipment are significant.

SUMMARY OF THE INVENTION

It is the primary object of the present invention to provide the article washing method which may shorten a washing time and reduce an amount of washing liquid to be used.

It is another object of the present invention to provide an article washing method which may reduce costs for construction and operation of the washing equipment used.

It is a further object of the present invention to provide an article washing method which may reduce costs for construction and operation of waste liquid treating equipment.

It is a still further object of the present invention to provide an article washing method which allows recovery of useful resources contained in a waste liquid.

According to the present invention, the article washing method comprises the steps of bringing an article into a washing chamber; spraying and washing liquid fed from a washing liquid tank to the article; separating off an initial most dirtied portion of the washing liquid used; repeating the spray with use of a cleaner washing liquid fed from another washing liquid tank if required; moving the article after treatment by the second spray to a washing liquid tank to immerse the article in a clean washing liquid; and sequentially supplying a part of the cleaner washing liquid from the latter stage to the washing liquid tank in the former stage so as to compensate for liquid reduction thereat due to the amount of washing liquid discharged. The present invention makes it possible to reduce the generation of a waste liquid to a minimum and an improved washing effect by setting optimum operational conditions.

Other objects and features of the invention will be more fully understood from the following detailed description and appended claims when taken with the accompanying drawings.

DETAILED DESCRIPTION OF THE PREFERRED EMBODIMENT

Figure 1:
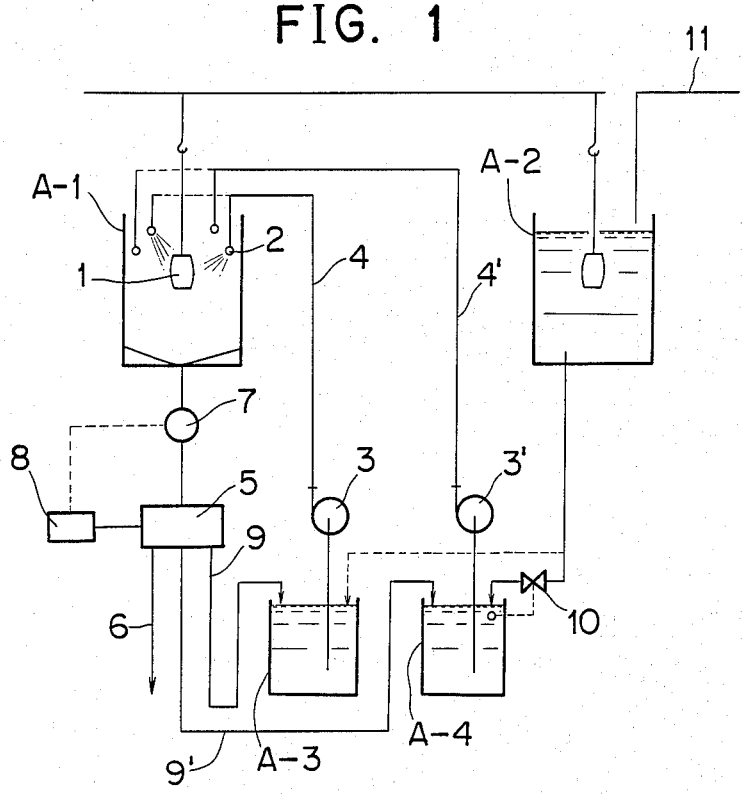
FIG. 1 is a flow diagram of the article washing method according to the present invention.
Figure 2:
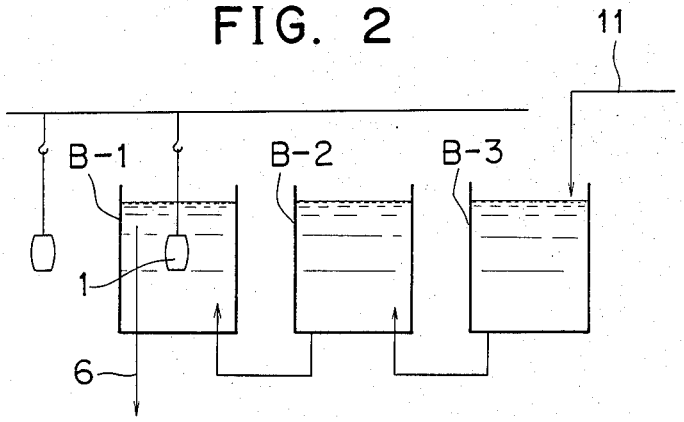
FIG. 2 is a flow diagram of an immersion washing process of a multi-stage counter current type known in the prior art.

Referring to FIG. 1, which shows a flow diagram of the article washing method according to the present invention, an article 1, i.e., an object to be washed is fed from the left-hand side by a conveyor, and is received in a washing chamber A-1. A plurality of washing liquid spray nozzles 2 are provided in the washing chamber A-1. A predetermined amount D of washing liquid is pumped from a first liquid storage tank A-3 through a pump 3 and piping 4 to the spray nozzles 2, and is sprayed from the spray nozzles 2 to the article 1 in the washing chamber A-1. The washing liquid that has treated the article 1 is drained from a lower portion of the washing chamber A-1, and a predetermined amount D, (e.g., 20 liters) of the washing liquid is fed through a selector valve 5 and a drain pipe 6 to a drain storage tank (not shown). A flow meter 7 for measuring flow of the washing liquid is provided. When the flow of the washing liquid passing through flow meter 7 reaches a selected value, a signal is fed from the flow meter 7 to a selector valve controller 8, and the selector valve 5 is operated so as to be communicate with a recovery pipe 9 for recovering the washing liquid back into the first liquid storage tank A-3.

Instead of using the flow meter for receiving a signal therefrom, the selector valve controller 8 may have a timer installed therein to operate the selector valve 5. Then, the washing liquid used is recovered to the first liquid storage tank A-3 by any amount thereof over a selected value. An initial part of the washing liquid that has been first sprayed to the article 1, i.e., $D_1$, contains much of the stain or dirt therefrom, and this initial part only is separated off to be fed to the drain storage tank (not numbered or shown). Therefore, the remaining washing liquid recovered to the first liquid storage tank A-3, i.e., $D_2$, contains relatively less stain dirt or contamination, and accordingly, it may be circulated for reuse. The various washing liquid amounts are related by the equation $D=D_1+D_2$.

After the washing liquid is sprayed for a predetermined time (e.g., 20 sec.), the pump 3 is stopped by a timer (not shown) to end a washing operation of a first stage. Thereafter, in the case that a washing operation of a second stage is carried out, a washing liquid in a second liquid storage tank A-4 is fed through a pump 3' to the spray nozzles 2, and is sprayed to the article 1 in the same manner as in the washing operation of the first stage. In this case, a predetermined amount (e.g., 20 liters) of the washing liquid at the beginning of the washing operation of the second stage, i.e., $D_1$, is recovered through the selector valve 5 to the first liquid storage tank A-3. Any excess amount $D_1$, i.e., $(X-D_1)$, of the washing liquid over that predetermined amount is recovered to the second liquid storage tank A-5 in the same manner as in the washing operation of the first stage. Thus, the washing operation of the second stage is continued for a predetermined time (e.g., 20 sec.; when selected to be the same as in the first stage washing operation), and then is ended.

Thus, after the spray washing of the second stage is ended, or the spray washing of the first stage if the second stage is not carried out, the article 1 is taken out from the washing chamber A-1, and is fed to a washing liquid tank A-2 by a conventional conveyor (not numbered). Then, the article 1 is immersed in a washing liquid stored in the washing liquid tank A-2. Fresh washing liquid (e.g., washing water) is supplied through a supply pipe 11 to the washing liquid tank A-2, while the washing liquid in the tank A-2 is supplied to the second liquid storage tank A-4, so as to compensate for any shortage of the washing liquid (20 liters), i.e., $D_1$, therein. The washing liquid in the second liquid storage tank A-4 is maintained at a substantially constant level by means of a float valve 10. Naturally, if the spray washing of the second stage is not carried out, the washing liquid in the tank A-2 is directly supplied to the first liquid storage tank A-3 rather than to the second liquid storage tank A-4.

The article 1 fed to the washing liquid tank A-2 and immersed in the washing liquid therein is taken out after a predetermined time (e.g., 20 sec. for the first stage only; 40 sec. for the first and second stages) has elapsed.

The overall process of the present invention is carried out in the aforementioned manner, wherein the amount of the washing liquid used can be reduced to $\frac{1}{3}$ to $\frac{1}{4}$ as compared with the conventional multi-stage washing method, and the treatment time can be shortened to 1/5 to $\frac{1}{8}$ because the number of times movement of the article is required among the tanks may be reduced, and the washing operation may be hastened by the spray washing.

Furthermore, while the conventional washing process by spray washing attains a high washing efficiency in the case of a simple form of the article, it still requires a long washing time so as to satisfy the washing requirements in the case of a complicated form of the article. To the contrary, according to the present invention, the difference in washing efficiency is not so influenced by the form of the article. Further, the washing time may be equalized or shortened as compared with the conventional spray washing process, and the amount of the washing liquid used may be also reduced.

While the invention has been described with reference to specific embodiments, the description and drawings are only illustrative and should not be construed as limiting the scope of the invention. Various modifications and changes may occur to those skilled in the art without departing from the spirit and scope of the invention as defined by the appended claims.

What is claimed is:

1. An article washing method wherein a dirty or contaminated article is washed with at least one spray nozzle in a washing chamber by using a specific washing liquid supplied to the nozzle with a pump from a first liquid storage tank, said washing chamber being connected selectively to a drain and said first liquid storage tank through a selector valve, comprising the steps of:

(a) bringing said article into said washing chamber;

(b) spraying a predetermined quantity D of said washing liquid pumped from said first liquid storage tank through said spray nozzle to said article to wash the contaminants therefrom by (i) first initially spraying and draining from said washing chamber an initial part $D_1$ of said washing liquid initially sprayed, to remove an initial portion of said contaminants washed from said article thereby, (ii) then subsequently spraying the article with a subsequent part $D_2$ of said washing liquid, wherein $D=D_1+D_2$, and (iii) switching the selector valve to recover the subsequent part $D_2$ of said washing liquid by directing said part $D_2$ from said washing chamber to said first liquid storage tank while continuing to wash said article; stopping the spray of said washing liquid after a first predetermined time has elapsed; removing said article from said washing chamber; transferring said article into a washing liquid tank to immerse the same in an amount of washing liquid stored in said washing liquid tank; removing said article from said washing liquid tank after a second predetermined time has elapsed; supplying an amount $D_1$ of said washing liquid from said washing liquid tank to said first liquid storage tank; and supplying an amount $D_1$ of fresh washing liquid to said washing liquid tank from a supply of fresh washing liquid.

2. An article washing method wherein a dirty or contaminated article is washed with at least one spray nozzle in a washing chamber by using a specific washing liquid selectively supplied to the nozzle with a pump from first and second liquid storage tanks, said washing chamber being connected selectively to a drain and to said first and second liquid storage tanks through a selector valve, comprising the steps of:

(a) bringing said article into said washing chamber;

(b) spraying a first predetermined amount D of said washing liquid pumped from said first liquid storage tank through said spray nozzle to said article to wash contaminants therefrom by (i) first initially spraying and draining from said washing chamber an initial part in an amount $D_1$ of said washing liquid initially sprayed to remove an initial portion of said contaminants washed from said article thereby, (ii) then subsequently spraying the article with a subsequent part in an amount $D_2$ of said washing liquid, wherein the amounts D, $D_1$ and $D_2$ are related by $D=D_1+D_2$, and (iii) switching the selector valve to recover the subsequent part $D_2$ of said washing liquid by directing said subsequent part $D_2$ from said washing chamber to said first liquid storage tank while continuing to wash said article; stopping the spray of said washing liquid after a first predetermined time has elapsed; spraying a second predetermined amount X of said washing liquid, pumped from a second liquid storage tank, through said spray nozzle to said article; recovering an amount equal to said amount $D_1$ of said amount X of sprayed liquid from said washing chamber to said first liquid storage tank; recovering a balance in an amount $(X-D_1)$ of said washing liquid from said washing chamber to said second liquid storage tank while continuing to wash said article; stopping the spray of said washing liquid after a second predetermined time has elapsed; removing said article from said washing chamber; transferring said article into a washing liquid tank to immerse the same in a quantity of said washing liquid held in said washing liquid tank; removing said article from said washing liquid tank after a third predetermined time has elapsed; supplying said washing liquid in an amount $D_1$ from said washing liquid tank to said second liquid storage tank; and supplying an amount $D_1$ of fresh washing liquid to said washing liquid tank from a supply of fresh washing liquid.

3. An article washing method according to claim 1, wherein:

said predetermined initial part $D_1$ of said washing liquid drained from said washing chamber does not exceed approximately 20 liters per washed article.

4. An article washing method according to claim 2, wherein:

said amount $D_1$ of said washing liquid drained from said washing chamber does not exceed approximately 20 liters per washed article.

5. An article washing method according to claim 1, wherein:

said first predetermined time does not exceed approximately 20 seconds.

6. An article washing method according to claim 2, wherein:

said first predetermined time does not exceed approximately 20 seconds.

7. An article washing method according to claim 3, wherein:

said first predetermined time does not exceed approximately 20 seconds.

8. An article washing method according to claim 4, wherein:

said first predetermined time does not exceed approximately 20 seconds.

9. An article washing method according to claim 2, wherein:

said second predetermined time does not exceed 20 seconds.

10. An article washing method according to claim 5, wherein:

said second predetermined time does not exceed 20 seconds.

11. An article washing method according to claim 1, wherein:

said second predetermined time does not exceed 20 seconds.

12. An article washing method according to claim 2, wherein:

said third predetermined time does not exceed 20 seconds.

13. An article washing method according to claim 9, wherein:

said third predetermined time does not exceed 20 seconds.

* * * * *